US011764011B2

(12) United States Patent
Kosse et al.

(10) Patent No.: US 11,764,011 B2
(45) Date of Patent: Sep. 19, 2023

(54) CURRENT INTERRUPTER SYSTEM

(71) Applicant: Siemens Energy Global GmbH & Co. KG, Munich (DE)

(72) Inventors: Sylvio Kosse, Erlangen (DE); Paul Gregor Nikolic, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 167 days.

(21) Appl. No.: 17/599,677

(22) PCT Filed: Feb. 17, 2020

(86) PCT No.: PCT/EP2020/054040
§ 371 (c)(1),
(2) Date: Sep. 29, 2021

(87) PCT Pub. No.: WO2020/200565
PCT Pub. Date: Oct. 8, 2020

(65) Prior Publication Data

US 2022/0189717 A1 Jun. 16, 2022

(30) Foreign Application Priority Data

Mar. 29, 2019 (DE) ..... 10 2019 204 443.3

(51) Int. Cl.
*H01H 33/666* (2006.01)
*H01H 3/46* (2006.01)

(52) U.S. Cl.
CPC ..... *H01H 33/666* (2013.01); *H01H 3/46* (2013.01)

(58) Field of Classification Search
CPC ..... H01H 33/666; H01H 33/6661; H01H 2033/6667; H01H 3/46; H01H 3/42; H01H 3/30; H01H 3/3031; H01H 2003/3094
USPC ..... 218/118, 120, 134, 139, 140, 153–154
See application file for complete search history.

(56) References Cited

U.S. PATENT DOCUMENTS 3,597,556 A * 8/1971 Sharp ..... H01H 3/46 218/4
3,839,612 A * 10/1974 Badey ..... H01H 33/14 218/7
4,163,133 A * 7/1979 Bould ..... H01H 3/30 200/400
4,550,234 A 10/1985 Steinemer
4,973,803 A * 11/1990 Fujiwara ..... H01H 33/666 218/120
5,113,056 A * 5/1992 Kuhn ..... H01H 3/301 200/82 R (Continued)

FOREIGN PATENT DOCUMENTS

DE 102019204441 A1 10/2020
EP 0115739 A1 8/1984

(Continued)

*Primary Examiner* — William A Bolton
(74) *Attorney, Agent, or Firm* — Laurence A. Greenberg; Werner H. Stemer; Ralph E. Locher

(57) ABSTRACT

A current interrupter system has a series arrangement of at least two interrupter units. At least one of the interrupter units is a vacuum tube, and the at least two interrupter units are mechanically connected to a drive system. The drive system has a drive assembly and a drive shaft. The drive shaft is a crank shaft equipped with at least two cranks. The at least two cranks have two crank strokes of different magnitudes.

11 Claims, 4 Drawing Sheets

(56) References Cited

U.S. PATENT DOCUMENTS

| | | | | |
|---|---|---|---|---|
| 5,347,096 | A * | 9/1994 | Bolongeat-Mobleu | H01H 33/122 218/84 |
| 5,510,590 | A * | 4/1996 | Hux | H01H 9/563 218/7 |
| 5,864,108 | A | 1/1999 | Roehling et al. | |
| 5,905,242 | A * | 5/1999 | Bernard | H01H 33/6661 218/78 |
| 5,981,889 | A * | 11/1999 | Niklaus | H01H 3/30 200/501 |
| 6,313,424 | B1 * | 11/2001 | Bachofen | H01H 9/563 200/337 |
| 8,717,716 | B2 * | 5/2014 | Hafner | H01H 9/542 361/8 |
| 2002/0121503 | A1 * | 9/2002 | Spiegel | H01H 3/30 218/154 |
| 2005/0150869 | A1 * | 7/2005 | Vaghini | H01H 33/125 218/118 |

FOREIGN PATENT DOCUMENTS

| | | | |
|---|---|---|---|
| JP | H01183023 | A | 7/1989 |
| WO | WO 95/22832 | A1 | 8/1995 |
| WO | WO 2012/019775 | A1 | 2/2012 |

* cited by examiner

CURRENT INTERRUPTER SYSTEM

FIELD AND BACKGROUND OF THE INVENTION

The invention relates to a current interrupter system with a series arrangement of at least two interrupter units, wherein at least one of the interrupter units is a vacuum tube, and the at least two interrupter units are mechanically connected to a drive system with a drive assembly.

When vacuum interrupters are used for a high-voltage application, it is frequently economically more favorable to connect two or more vacuum interrupters in series in order to obtain the required dielectric strength. The design means that, in the case of this series connection, structurally different vacuum interrupters have to be connected simultaneously. For this purpose, each interrupter is conventionally provided with a dedicated drive or with a dedicated drive system, wherein the drive systems are synchronized with one another. A similar challenge arises whenever a vacuum interrupter is connected parallel to a gas supply system for various applications. Different drives are also required in each case here in order to connect the two interrupter units synchronously. However, the use of a plurality of drive systems having a plurality of drive assemblies again affects the economical balance of using two vacuum tubes connected in series or of the series connection of a vacuum tube and a gas supply system.

SUMMARY OF THE INVENTION

The object of the invention consists in providing a current interrupter system which has at least two interrupter units of different design that are driven by a common drive system.

The object is achieved in a current interrupter system as claimed.

The current interrupter system as claimed has a series arrangement of at least two interrupter units. At least one interrupter unit from amongst said interrupter units is a vacuum tube, wherein the at least two interrupter units are mechanically connected to a drive system. The drive system has a drive assembly, and is distinguished in that there is a crank shaft as drive shaft which has at least cranks, wherein the at least two cranks have two crank strokes of different magnitudes.

The crank shaft strokes of different magnitudes make it possible to operate two interrupter units of different design via a single drive shaft and thus also different strokes with one drive unit and one drive system. This affords economical advantages since only one drive system, in particular one drive assembly, is required for the two interrupter units.

The term crank is understood as meaning an eccentricity which is applied to the crank shaft and runs substantially perpendicular with respect to the axis of rotation of the crank shaft. In the simplest case, the crank here can be configured to be virtually rod-shaped. In practice, in order to avoid unbalances, it is generally configured in the form of asymmetrical eccentric disks. The term crank is also understood as meaning a pair of cranks arranged at a distance from one another along the crank shaft and being connected to one another eccentrically with respect to the axis of rotation via a crank pin running substantially parallel with respect to the axis of rotation.

The term crank stroke is understood as meaning the eccentricity of the crank pin with respect to the axis of rotation of the crank shaft, wherein, during a rotational movement of the crank shaft, the crank pin describes a circular movement about the axis of rotation of the crank shaft. The crank stroke therefore also corresponds to the radius of said described circular movement of the crank pin.

The term series arrangement of interrupter units is understood as meaning that the interrupter units are electrically connected in series.

In an advantageous embodiment of the invention, the crank shaft carries out a unidirectional movement during an opening operation of the interrupter units. This has the advantage that the drive can in turn be configured to be technically simpler than the prior art since it has to be rotatable only in one direction. The possibility of the unidirectional rotational movement during an opening operation, in particular during an opening operation, with a rotation of 170 to 170°, preferably 180°, is made possible by the use of the crank shaft according to the invention.

A further advantage is afforded by the use of the crank shaft as drive shaft of the drive system whenever an opening operation of the interrupter units and a following closing operation carries out a unidirectional movement of between 350° and 360°+10°. In this case, the crank shaft carries out an opening and a closing operation during one full revolution which is preferably 360°, and, by adjusting certain excessive contact strokes, it may also be expedient for the crank shaft to carry out a rotational movement which deviates slightly from the 360°, i.e. by +/−10°.

In a preferred embodiment of the invention, in each case two different interrupter units are mechanically connected to the respective different cranks of the crank shaft, said cranks having a different crank stroke, wherein the two interrupter units differ in that they have different rated voltages. The rated voltage of an interrupter unit is the voltage up to which the interrupter unit can interrupt technically permitted current flows. Interrupter units with different rated voltages can thereby be connected to one another in series, thus resulting in a category of rated voltage immediately above. For this purpose, it is expedient to use different interrupter units.

The term mechanically connected is understood as meaning that, in order to transmit a force, a pulse or an action between two systems, there is a mechanical connection which can take place, for example, via movable connections, such as bearings or joints, but also via fixed connections, such as integrally bonded or force-fitting connections, or of combinations of movable and fixed connections.

In a further embodiment of the invention, it is furthermore expedient to connect three identical pairs of interrupter units connected in series mechanically to one another. The three pairs of interrupter units form the three phases of the power supply, and therefore, by means of this embodiment, the three phases each having two interrupter units connected in series can be operated up to a predefined rated voltage by a single drive system.

In one structural embodiment of the current interrupter system, the mechanical connection between the crank shaft and the respective interrupter unit has a crank pin which is arranged between two cranks in such a manner that it runs at a distance from an axis of rotation of the crank shaft, wherein the crank pin is surrounded by a plain bearing which, in turn, is arranged on a push rod. Such a structural embodiment makes it possible to convert the rotational movement of the crank shaft into a translational movement of a moving contact of the interrupter system. The push rod is furthermore connected mechanically to the contact bolt; this can take place in turn in particular by means of a further plain bearing on the push rod, said plain bearing being attached in turn to a pin on the contact bolt. A described push rod having a plain bearing at both ends may also be referred to as a connecting rod.

In a further embodiment of the invention, the crank shaft is configured such that a radial orientation of the crank stroke of two adjacent cranks along the crank shaft are arranged offset by 180°. This leads to the individual interrupter units which are mechanically connected to the respective crank pins of the crank shaft being arranged offset with respect to one another with respect to a line along the crank shaft, which results in a saving on construction space. Such an arrangement of interrupter units therefore requires less construction space, which is of benefit in particular when the interrupter units are arranged in closed spaces.

Further embodiments and further features of the invention will be explained in more detail with reference to the figures below. These are purely schematic illustrations which do not signify any restriction of the scope of protection. Features which have the same designation in different embodiments are provided here with the same reference sign which may be identified with an additional prime.

DETAILED DESCRIPTION OF THE INVENTION

Figure 1:
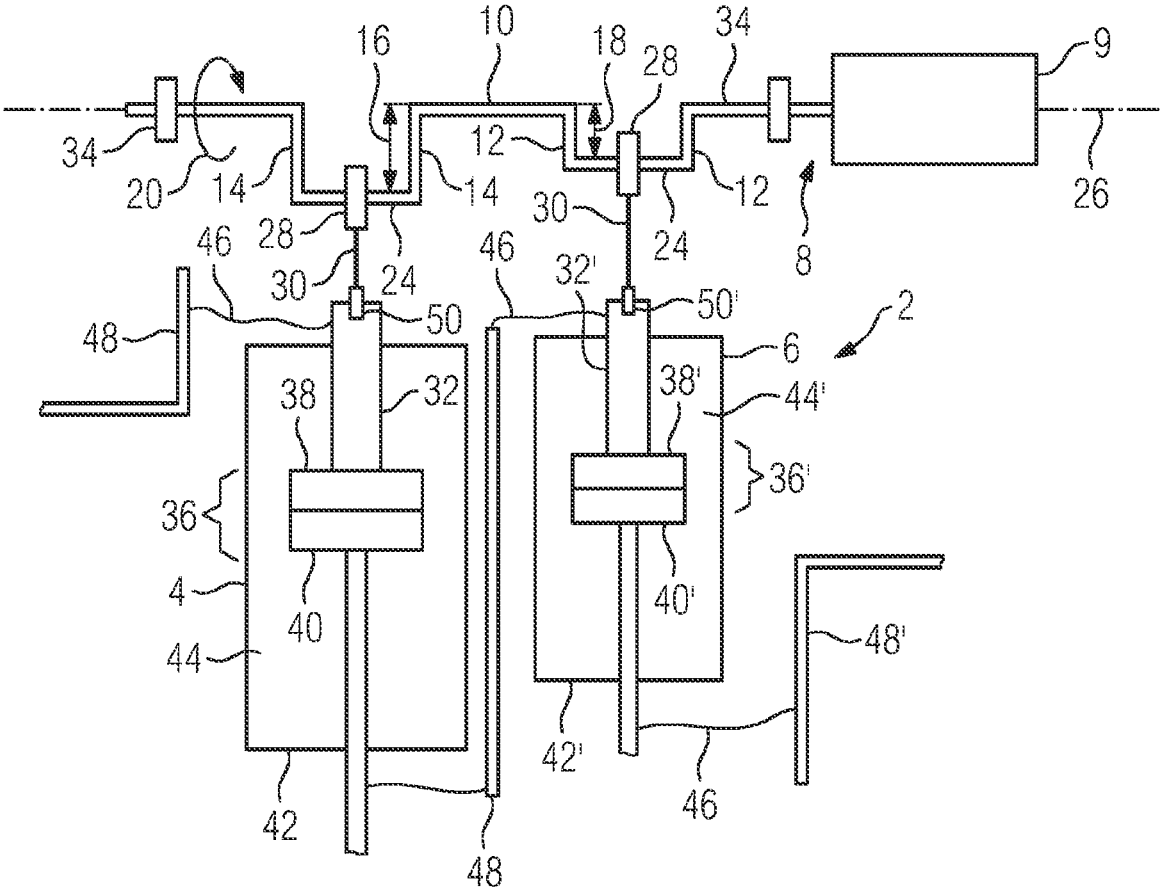
FIG. 1 shows a current interrupter system with a drive unit and two different interrupter units in the form of vacuum interrupters.

FIG. 1 illustrates a current interrupter system 2 which has a drive system 8 which jointly drives two different interrupter units 4 and 6. The drive system 8 here comprises a drive assembly 9 and a crank shaft 10. In this embodiment, the crank shaft 10 is mounted by way of example on two crank shaft bearings 34 and carries out a unidirectional rotational movement along the arrow 20. The crank shaft 10 here has two cranks 12 and 14 which each have a different crank stroke 18 and 16. The term crank 12 is also understood here as meaning a pair of cranks 12 and 12' or 14 and 14', between which a crank pin 24 is arranged. The crank pin 24 runs here parallel to an axis of rotation 26 of the crank shaft 10. During a rotational movement 20, the crank pin 24 here describes a circular movement about the axis of rotation 26. Plain bearings 28 are in turn attached to the crank pins 24 and are connected to a push rod 30. A further plain bearing 50 is arranged in turn at the end of the push rod 30 and is connected to a contact bolt 32 of the interrupter unit.

Figure 2:
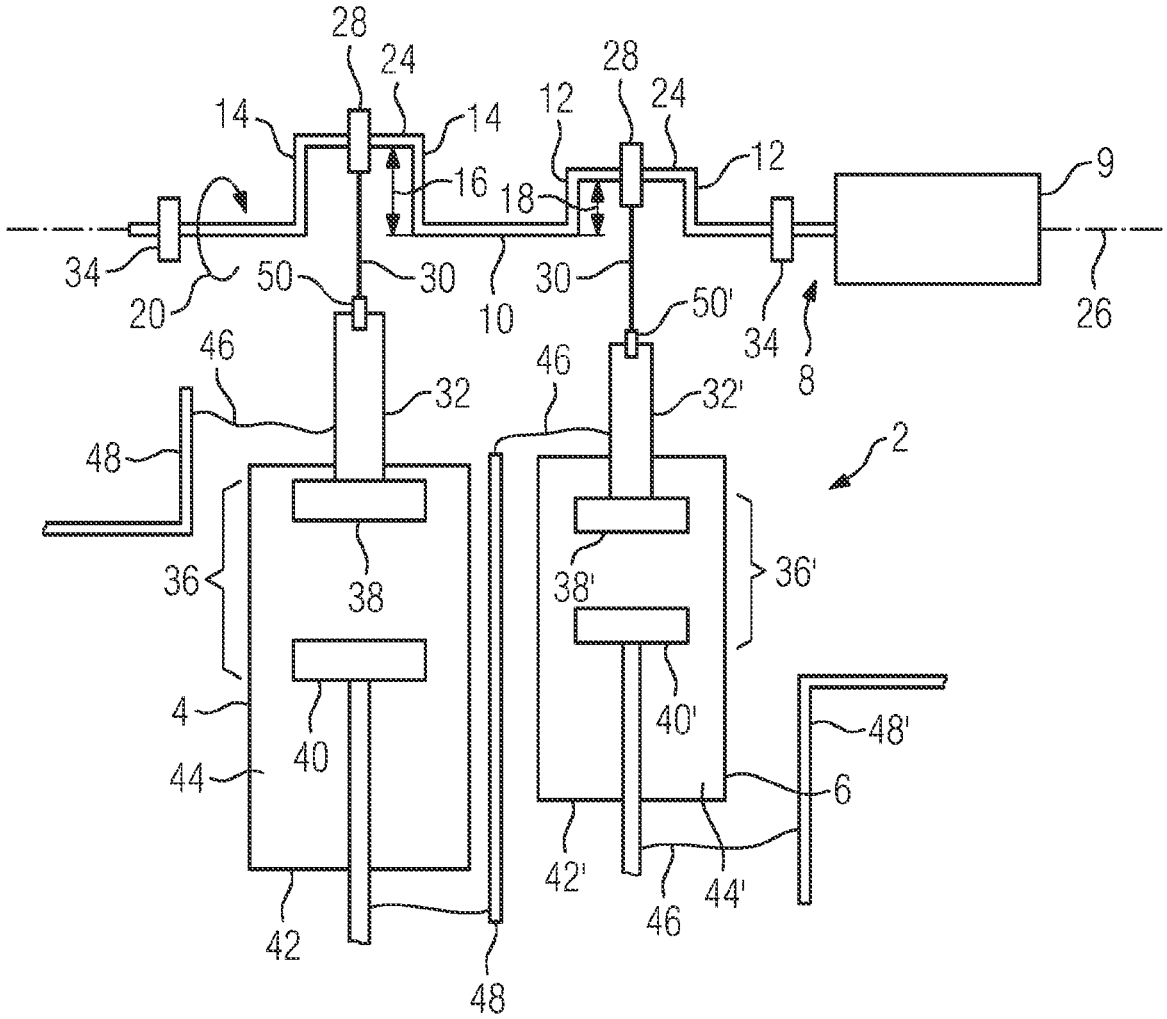
FIG. 2 shows the current interrupter system according to FIG. 1 in an open state.

The interrupter units 4, 6 here have a contact system 36 which comprise two contacts, a moving contact 38 and a fixed contact 40. The contact system 36 is arranged in a vacuum chamber 44 surrounded by a housing 42. The illustration according to FIGS. 1 and 2 can be seen purely schematically, and details of the interrupter units 4, 6, which are configured in the form of vacuum interrupters, are not illustrated here. The moving contact 38 is connected here to the contact bolt 32 which has already been mentioned, wherein, during a translational movement of the contact bolt 32, the contact system 36 is opened, as is illustrated in FIG. 2. By means of the rotational movement 20 of the crank shaft 10 is transmitted by the push rod 30, which is configured in the form of a connecting rod, and converted into a translational movement of the contact bolt 32 and therefore of the moving contact 38. This kinematic sequence applies equally to both interrupter units 4, 6. The difference between the sequence during the opening of the contact systems 36 and 36' consists, according to this illustration, in that the crank stroke 18 for the smaller interrupter unit 6 turns out to be smaller than the crank stroke 16 for the larger interrupter unit 4. In this way, different interrupter units 4, 6 which have different rated voltages and are connected serially to each other can be operated with one drive system 8.

The series connection of the two interrupter units 4, 6 is produced by a contact connection via bus bars 48, which are electrically connected to a flexible current connector 46, which in turn makes contact with the contact bolt 50. A further connection via bus bars 48 and current connectors 46 furthermore takes place via the fixed contact 40 and a bolt assigned thereto and the moving contact 32' of the interrupter unit 6. There can be two vacuum interrupters which, for example, have a rated voltage of 170 kV (interrupter unit 4) and a rated voltage of 145 kV (interrupter unit 6). By means of this series arrangement of vacuum interrupters with different rated voltages, the rated voltage of the overall current interrupter system is accumulated from the rated voltages of the individual interrupter units.

FIG. 1 describes the basic position of the current interrupter system 2 in the closed state of the interrupter units 4 and 6, but the arrow 20, which illustrates a unidirectional rotational movement 20 of the crank shaft 10, also shows that the illustration in FIG. 1 is a dynamic illustration which, in the event of a 180° rotation along the arrow 20, results in the open position of the current interrupter system 2 according to FIG. 2. A further unidirectional rotation along the arrow 20 after the opening position according to FIG. 2 leads in turn to a closing movement and ultimately to the state which is depicted in FIG. 1. A 360° rotation of the crank shaft 10 thus results in the interrupter units 4, 6 being opened once and closed again. A further rotation about 180° would in turn result in an opening movement.

The advantage of the continuously unidirectional movement of the crank shaft 10, driven by the drive assembly 9, consists in that, in addition to the simplified transmission by a single drive system 8, it is also possible to select a more cost-effective drive variant with regard to the drive assembly 9. A technically complicated, bidirectional driving movement can be dispensed with here, with this not absolutely being necessary. The transition from open position and closed position of the interrupter units 4, 6, as is illustrated in FIGS. 1 and 2, can basically also take place with a bidirectional movement, but a unidirectional movement is firstly made possible by the use of the crank shaft 10 and leads to technically less complicated drive assemblies 9, for example electric motors or spring stores having spiral springs, being able to be used.

Figure 3:
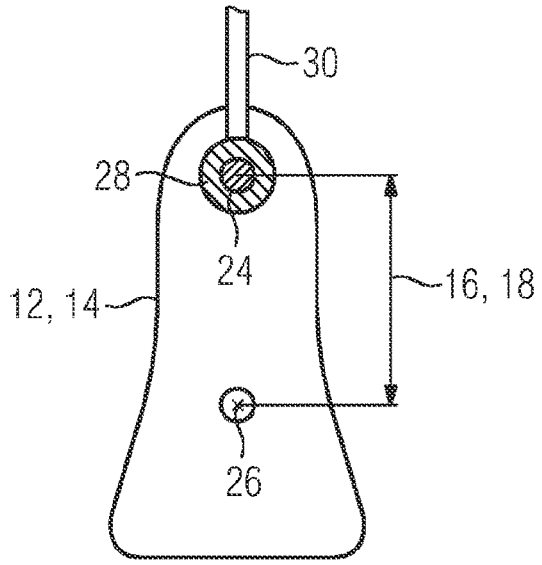
FIG. 3 shows a cross section through a crank shaft of the drive system in the region of a crank pin.

FIG. 3 illustrates a cross section through a crank shaft 10, with the cross-sectional profile in the region of a crank being sectioned through a crank pin 24 and through a plain bearing 28. The crank which can be configured both in the form of the cranks 12 or 14 is here, by way of example, an eccentric disk which, in order to avoid imbalances, has a counterweight on the other side of the axis of rotation 26 of the crank shaft 10. The respectively possible crank stroke 16 or 18 is illustrated by the double arrow which runs between the center point of the axis of rotation 26 and the center point of the crank pin 24. If the crank 12, 14 rotates about the axis of rotation 26, the crank pin 24 carries out a circular movement about the axis of rotation 26. The plain bearing 28 which is arranged around the crank pin 24 rotates here in the process since it is connected to a push rod 30, at the end of which, as illustrated in FIG. 1, there is a further plain bearing 50, but the latter is in each case oriented along a translational movement and transmits said movement to the contact bolt, not illustrated here.

In a further refinement of the invention, in each case three pairs 22 of interrupter units 4 and 6 connected in series are arranged on the crank shaft 10. One pair 22 of the interrupter units 4 and 6 in each case carries out the function that are already described with respect to FIGS. 1 and 2. The arrangement of three such structurally identical pairs of interrupter units 4, 6 represents the three phases of a power supply that have to be separated simultaneously by a respective interrupter unit or here by a pair 22 of interrupter units 4, 6. It is possible here to operate all three phases with one drive unit 8, wherein, as already mentioned, each phase has two different interrupter units 4, 6. Each pair 22 of interrupter units 4, 6 is connected here in each case to a pair of cranks 14, 16 which each again have the different contact stroke 16 and 18. Otherwise, the pairs 22 have the same technical features which have already been described with respect to FIGS. 1, 2 and 3.

Figure 4:
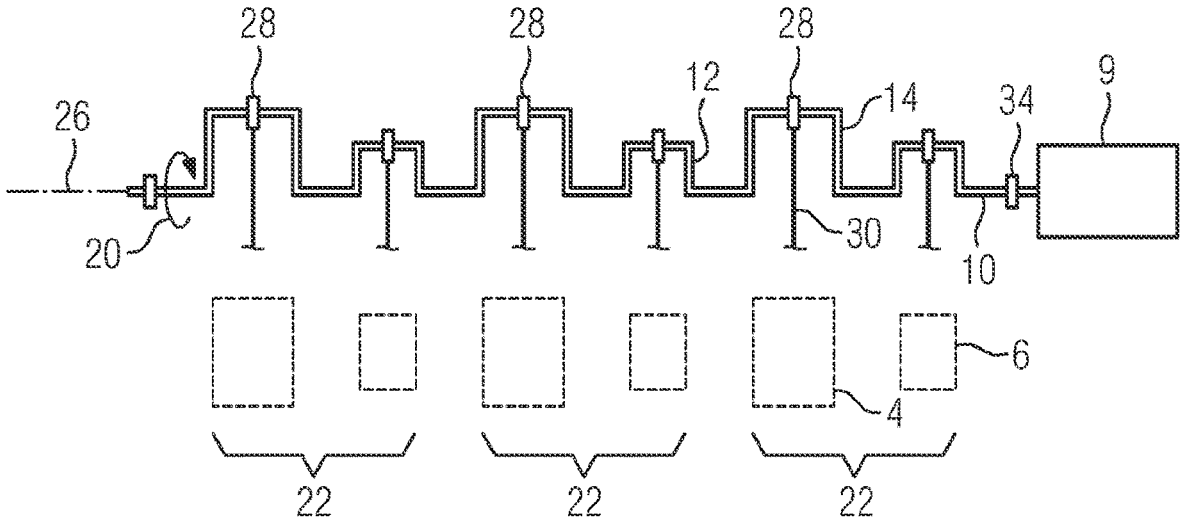
FIG. 4 shows a schematic illustration of a current interrupter system with in each case two interrupter units which are connected in series for three phases, with a total of six interrupter units.
Figure 5:
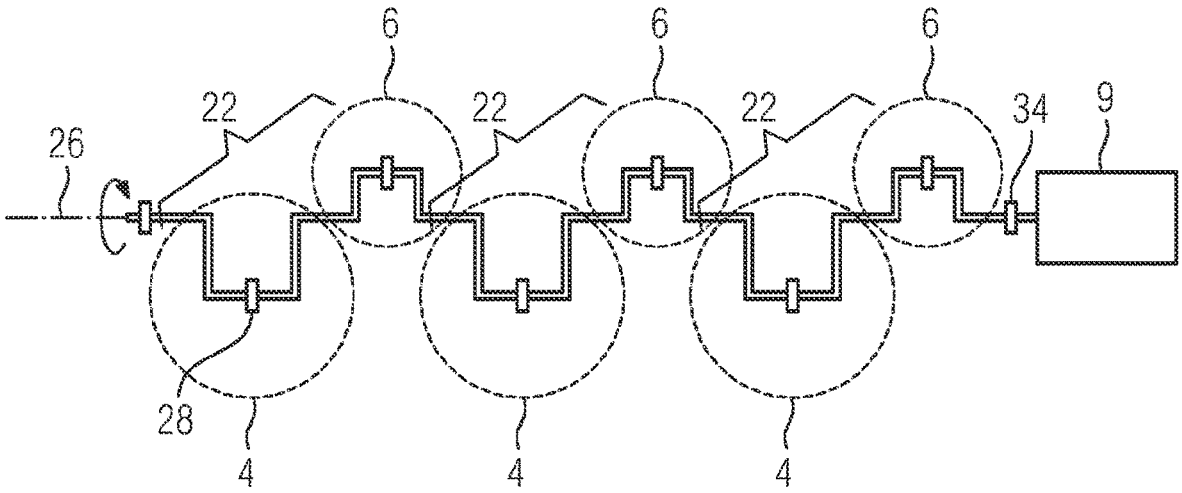
FIG. 5 shows an analogous schematic illustration as in FIG. 4 with interrupter units arranged offset with respect to a line and with crank strokes in radially different directions.

In a further embodiment similarly to in FIG. 4, the schematic illustration according to FIG. 5 has an arrangement of three pairs 22 of interrupter units 4, 6 connected in series. The difference with regard to FIG. 4 consists in that, in this embodiment, in each case two interrupter units 4 or 6 are arranged offset with respect to each other, which leads to construction space being able to be saved linearly along the crank shafts 10, which, in many applications in which construction space is tight, can afford a decisive advantage in terms of costs. The crank shaft 10 according to FIG. 5 is configured in such a manner that the cranks 14 and 12 face radially with respect to the axis of rotation 26 in different directions, in particular in directions offset by 180°. However, it should be noted that, in this implementation, at least every second crank 12 or 14 and the push rod 30 connected thereto requires a mechanical deflecting mechanism which is not described specifically in this purely schematic illustration according to FIG. 5.

LIST OF REFERENCE SIGNS

2 Current interrupter system
4 Interrupter unit $U_{B1}$
6 Interrupter unit $U_{B2}$
8 Drive system
9 Drive assembly
10 Crank shaft
12 First crank
14 Second crank
16 First crank stroke
18 Second crank stroke
20 Unidirectional rotational movement
22 Pair of interrupter units connected in series
24 Crank pin
26 Axis of rotation
28 Plain bearing
30 Push rod
32 Contact bolt
34 Crank shaft bearing
36 Contact system
38 Moving contact
40 Fixed contact
42 Housing
44 Vacuum chamber
46 Current connector
48 Bus bars
50 Further plain bearing

The invention claimed is:

1. A current interrupter system, comprising:
a series arrangement of at least two interrupter units;
at least one of said interrupter units being a vacuum tube;
a drive system mechanically connected to said at least two interrupter units, said drive system including a drive assembly and a drive shaft;
said drive shaft being a crank shaft with at least two cranks having two crank strokes of mutually different magnitudes.

2. The current interrupter system according to claim 1, wherein said crank shaft is configured to carry out a unidirectional rotational movement during an opening operation of said interrupter units.

3. The current interrupter system according to claim 2, wherein said crank shaft is configured for a unidirectional rotational movement of between 170° and 190° during the opening operation of the interrupter units.

4. The current interrupter system according to claim 2, wherein said crank shaft is configured for a unidirectional rotational movement of substantially 180° during the opening of the interrupter units.

5. The current interrupter system according to claim 1, wherein said crank shaft is configured to carry out a unidirectional rotational movement of between 350° and 360°+10° during an opening operation and a following closing operation of said interrupter units.

6. The current interrupter system according to claim 1, wherein said at least two interrupter units are connected electrically in series with one another and mechanically connected to a respective crank having different crank strokes, and wherein said at least two interrupter units have different rated voltages.

7. The current interrupter system according to claim 6, wherein three identical pairs of said interrupter units that are connected in series are mechanically connected to said crank shaft.

8. The current interrupter system according to claim 6, further comprising a crank pin forming a mechanical connection between said crank shaft and a respective said interrupter unit, said crank pin being arranged between two cranks at a distance from an axis of rotation of said crank shaft, and a plain bearing surrounding said crank pin and being connected to a push rod.

9. The current interrupter system according to claim 8, wherein said push rod is mechanically connected to a contact bolt.

10. The current interrupter system according to claim 9, which comprises a further plain bearing forming a mechanical connection between said push rod and said contact bolt.

11. The current interrupter system according to claim 1, wherein a radial orientation of the crank stroke of two mutually adjacent cranks along said crank shaft is offset by 180°.

* * * * *